US007628611B2

(12) United States Patent
Beiter et al.

(10) Patent No.: US 7,628,611 B2
(45) Date of Patent: Dec. 8, 2009

(54) LOW CONDUCTIVITY REFRACTORY INSULATION MEMBER WITH FIBER MAT

(75) Inventors: Christopher K. Beiter, Cranberry Township, PA (US); Gerry Dickins, Aylesbury Bucks (GB); Robert F. Green, Bethel Park, PA (US)

(73) Assignee: Bloom Engineering Company, Inc., Pittsburgh, PA (US)

( * ) Notice: Subject to any disclaimer, the term of this patent is extended or adjusted under 35 U.S.C. 154(b) by 241 days.

(21) Appl. No.: 11/496,015

(22) Filed: Jul. 28, 2006
(Under 37 CFR 1.47)

(65) Prior Publication Data

US 2007/0167098 A1 Jul. 19, 2007

Related U.S. Application Data

(60) Provisional application No. 60/703,650, filed on Jul. 29, 2005.

(51) Int. Cl.
*F27D 3/02* (2006.01)

(52) U.S. Cl. ..... 432/234; 122/511; 138/149

(58) Field of Classification Search ..... 432/234, 432/225; 122/511, 494; 138/147, 149
See application file for complete search history.

(56) References Cited

U.S. PATENT DOCUMENTS 2,693,352 A * 11/1954 Bloom ..... 432/234
4,071,311 A * 1/1978 Errington ..... 432/234
4,140,483 A * 2/1979 Errington ..... 432/234
4,182,609 A * 1/1980 Hovis et al. ..... 432/234
4,189,301 A * 2/1980 Twort ..... 432/252
4,305,706 A * 12/1981 Brungraber ..... 432/234
4,337,034 A * 6/1982 Morgan et al. ..... 432/234
4,386,630 A * 6/1983 Gapinski ..... 138/149
5,020,481 A * 6/1991 Nelson ..... 122/494
5,056,564 A * 10/1991 Roth ..... 138/149
5,307,842 A * 5/1994 Lequeux ..... 138/149
5,724,923 A * 3/1998 Green ..... 122/511
5,934,337 A * 8/1999 Fiala et al. ..... 138/149
6,343,624 B2 * 2/2002 Neumann ..... 138/149

* cited by examiner

*Primary Examiner*—Gregory A Wilson
(74) *Attorney, Agent, or Firm*—The Webb Law Firm

(57) ABSTRACT

A thermo-insulation article for a heat absorptive element, e.g., a water-cooled pipe, in a furnace has two parts joined to form a member for covering the pipe. Each part has an interconnected reticulated metal structure embedded in a refractory material. A thermo-insulating mat mounted over inner surface of the parts has a thermal conductivity lower, e.g., equal to or less than 25% lower, than thermal conductivity of the refractory material of the part. In one non-limiting embodiment of the invention, the thermo-insulating mat has a thermal conductivity equal to or less than 0.15 Btu's/hour/ft/degrees Fahrenheit, and the refractory material has a thermal conductivity in the range of 0.30-0.60 Btu's/hour/foot/degrees Fahrenheit. A surface of the mat is embedded in the refractory material and, optionally, a protective layer covers outer exposed surface of each of the mats to protect the mats during shipping and handling.

19 Claims, 2 Drawing Sheets

LOW CONDUCTIVITY REFRACTORY INSULATION MEMBER WITH FIBER MAT

CROSS REFERENCE TO RELATED APPLICATION

This application claims the benefit of U.S. Provisional Application Ser. No. 60/703,650, filed Jul. 29, 2005, and titled "Low Conductivity Refractory Insulation Member With Fiber Mat", which application is incorporated herein by reference in its entirety.

BACKGROUND OF THE INVENTION

1. Field of the Invention

This invention relates to a low conductivity refractory insulation article, e.g., a thermal insulation member, having a fiber mat and, more particularly, to a thermal insulating hollow member or sleeve having a thermal insulating fiber mat on the inner surface of the sleeve. In one non-limiting embodiment of the invention, the sleeve is mounted on water-cooled pipes in work piece support structures in a heat-treating furnace to thermally insulate and protect the pipes.

2. Description of the Available Technology

A number of different furnace insulation systems are utilized in modern day furnaces to protect the metal structures contained in the furnace and to minimize heat losses of the furnace. More particularly, the metal structures in the furnace, such as skid pipes, crossover pipes, and other support members, on pusher furnaces, and moving and fixed horizontal beams on walking beam furnaces are subjected to high and cyclic temperatures, repetitive vibrations, scale buildup, and occasional damaging blows from work pieces or chunks of metal and scale. Further, the pipes are normally hollow and water-cooled, thereby making them extremely heat absorptive.

U.S. Pat. Nos. 4,182,609 and 4,189,301 each disclose presently available insulating systems. Of particular interest in the present discussion is the insulating system disclosed in U.S. Pat. No. 4,189,301, which includes a cast refractory insulating member into which is solidly embedded a reticulated metal mesh reinforcement member having a fibrous insulating material engaged within mesh loops of the reticulated metal structure. The fibrous insulating material has better heat insulating properties than the cast refractory material.

Although the insulating member of U.S. Pat. No. 4,189,301 provides better heat insulating properties than most, if not all, other available insulating systems, there are limitations. More particularly, the fibrous insulating material has to be cut into strips and threaded through the wire loops of the mesh reinforcement member. This procedure is time consuming and/or expensive, e.g., eliminating the cutting and threading steps would reduce the cost of making the insulating member. Further, the strips of the fibrous insulating material preferably completely fill the wire loops when a refractory insulating material is subsequently cast onto the reticulated metal structure. In this manner, the cast refractory material enters the wire loops, and the reinforcement member is at least partly embedded within the refractory insulating material to reinforce both the refractory and the strips of fibrous materials and creates a bond between the two materials, which imparts a high degree of strength to the entire insulating member. As can be appreciated, when the strips of the fibrous material only partially fill the wire loops, less than the maximum thickness, length, and/or width of the strips are used, thereby reducing the maximum thermal insulation benefit that can be realized by using the fibrous insulating material with the castable refractory material. Lightweight, possible refractory material has been available for some time but its conductivity was too high resulting in bum-up of the mesh regarding enforcement and further necessitating the tedious cutting and threading steps.

As can be appreciated, it would be advantageous to provide an insulating system that includes a cast refractory insulating member, a mesh reinforcement member, and a fibrous insulating material that has heat insulating properties as good as, if not better than, the presently available insulating system and does not have the limitations of the presently available insulating system.

SUMMARY OF THE INVENTION

This invention relates to an improved thermo-insulation article for insulating a heat absorptive element in a heated chamber, e.g. and not limiting to the invention, a water-cooled pipe of a furnace. In one non-limiting embodiment of the invention, the article has at least two parts adapted to be connected to form a heat insulating member for positioning about the element. Each part includes an interconnected metal structure embedded in a refractory material, e.g., a reticulated metal structure solidly embedded in the refractory material. A surface of the refractory material of the part defined as an inner surface is designated to face the absorptive element. The improvement includes, among other things, a thermo-insulating mat having a first surface and an opposite second surface, with the first surface of the mat secured to the inner surface and the second surface of the mat spaced from the metal structure. The interconnected reticulated metal structure solidly embedded in the refractory material provides the article with structural stability to protect the heat absorptive element. The metal structure may abut the first surface of the mat.

In another non-limiting embodiment of the invention, the thermo-insulating mat has a thermal conductivity lower than thermal conductivity of the refractory material underlying the mat, e.g., equal to or less than 25% of the thermal conductivity of the refractory material underlying the mat. In still another non-limiting embodiment of the invention, the thermo-insulating mat has a thermal conductivity equal to or less than 0.15 British thermal units/hour/foot/degrees Fahrenheit and the thermal conductivity of the refractory material underlying the mat has a thermal conductivity in the range of 0.30-0.60 British thermal units/hour/foot/degrees Fahrenheit. It will be understood that thermal conductivity measurements are temperature dependent.

In a further non-limiting embodiment of the invention, each part has a first edge and an opposite second edge, with the first edge of the mats adjacent and spaced from the first side of their respective one of the parts and the second edge of the mats adjacent and spaced from the second side of their respective one of the parts, and a ledge of refractory material between the ends of the parts and the respective edge of their respective mat.

Other non-limiting embodiments of the invention include but are not limited to a major surface of the mat embedded in the refractory material of its respective part and, optionally, a protective layer over surface of each of the mats facing away from their respective part.

The invention further relates to a method of making a thermo-insulation article, including the steps of positioning a thermo-insulating mat on inner convex surface of a mold, the mat having a predetermined thermo conductivity; positioning a wire mesh in the mold spaced from the mat; adding a fluid refractory material to the mold; and solidifying the fluid refractory material to provide a part of the thermo-insulation article, wherein the solidified refractory material has a predestined thermo conductivity greater than the thermo conductivity of the mat.

In another non-limiting embodiment of the invention, the steps of positioning a thermo-insulation mat, positioning a wire mesh, adding a fluid refractory material, and solidifying the fluid refractory material are repeated to provide a second part of the thermo-insulating article, wherein joining the first and second parts provides the thermo-insulating article.

DETAILED DESCRIPTION OF THE PREFERRED EMBODIMENTS

Figure 1:
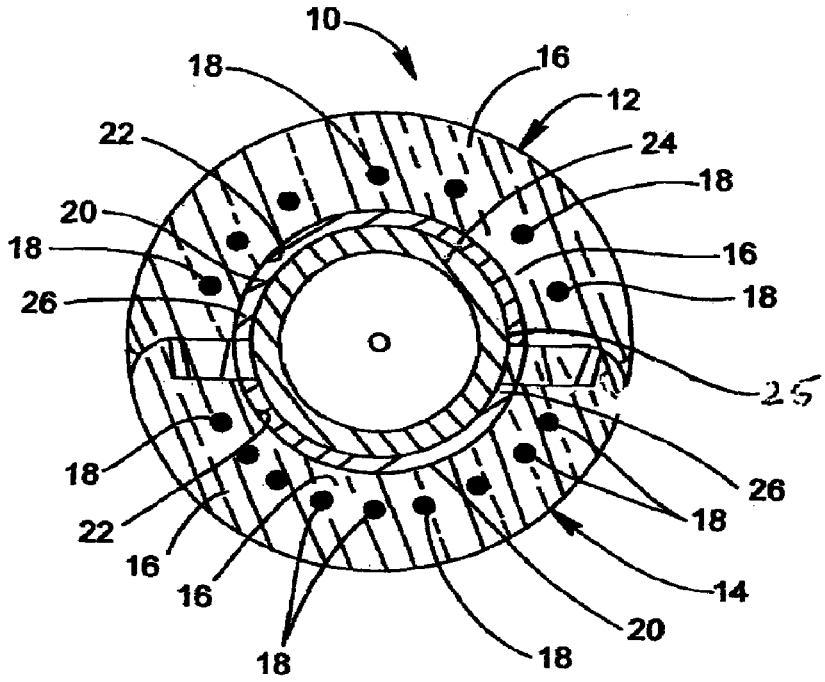
FIG. 1 is a cross-sectional view taken normal to the long axis of one non-limiting embodiment of a low conductivity elongated refractory insulation member of the invention mounted on a water-cooled pipe.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10. Also, as used herein, the terms "deposited over", "applied over", or "provided over" mean deposited, applied, or provided on but not necessarily in contact with the surface. For example, a material "deposited over" a substrate does not preclude the presence of one or more other materials of the same or different composition located between the deposited material and the substrate.

In the preferred practice of the invention but not limited thereto, the low conductivity refractory insulating member with a fiber mat will be discussed as a hollow member or sleeve having a circular hole for mounting on a water-cooled pipe, e.g. but not limiting to the invention, similar in shape to the protective refractory member disclosed in U.S. Pat. No. 4,182,609; however, the invention is not limited thereto, and the hole of the insulating member of the invention can have any cross-sectional configuration, e.g. but not limiting to the invention, circular, elliptical, three or more flat sides, curved sides, or combinations of flat and curved sides. The disclosure of U.S. Pat. No. 4,182,609 is hereby incorporated by reference.

The refractory insulating member of the invention can be employed in any type of furnace to thermally insulate and protect the metal support structures, which can include water-cooled pipes, which are very heat absorptive. A typical example of such a furnace is a multi-zone reheat furnace for steel slabs prior to hot rolling. It is understood that the invention is not limited in its application to the details of the particular non-limiting embodiments shown and discussed herein since the invention is capable of other embodiments. Further, the terminology used herein to discuss the invention is for the purpose of description and is not of limitation. Still further, unless indicated otherwise in the following discussion, like numbers refer to like elements.

With reference to FIG. 1, in one non-limiting embodiment of the invention, heat-insulating refractory article or member 10 includes refractory components or parts 12 and 14, each having a body 16 of a castable or pressed low density insulating refractory material, a reticulated wire mesh member 18 embedded within the outer body 16 of the refractory material, and a fibrous thermal insulating mat 20 mounted, e.g., secured, on inner surface 22 of the outer body 16 of the parts 12 and 14. The heat-insulating refractory member 10 is mounted on pipe 24 (shown only in FIG. 1) with the fibrous thermal insulating mat 20 preferably in surface contact with outer surface 25 of the pipe 24. As is appreciated by those skilled in the art, the reticulated wire mesh member 18 embedded in the refractory material provides the parts 12 and 14 with structural stability to protect the metal support structures. The invention, however, contemplates making the parts 12 and 14 without the reticulated wire mesh member 18. With this arrangement, the member 10 provides the thermo-insulation properties of the invention.

The body 16, in one non-limiting embodiment of the invention, is a refractory material having low density, high strength, and low thermal conductivity properties. For example and not limiting to the invention, the density of the dried cured refractory material, i.e., on a dry basis, of the outer body is in the range of 80-110 pounds/cubic foot ("lb/ft$^3$") and, more preferably, 90-100 lb/ft$^3$ and, most preferably, 95 lb/ft$^3$. The modulus of rupture of the dried cured refractory material is preferably, but not limited to the invention, in the range of 550-1,000 pounds/square inch measured using applicable ASTM test procedure. In a preferred non-limiting embodiment of the invention, the outer body 16 of the refractory material is phosphate bonded. Refractory materials that can be used in the practice of the invention but not limited thereto can be purchased from ANH Refractories of Moon Township, Pa.

The reticulated wire mesh member 18 can be made of any metal useable in a heated environment. Reticulated wire mesh that can be used in the practice of the invention but not limited thereto can be 314 stainless steel purchased from any wire mesh company.

The fibrous thermal insulating mat 20 of the invention is not limited to any specific type of mat or material and the invention contemplates using various fibrous insulating materials, e.g., the fibrous insulating materials disclosed in U.S. Pat. No. 4,189,301, the disclosure of which is hereby incorporated by reference. In general and not limiting to the invention, ceramic fiber material is preferred but glass fibers and high-grade synthetic fibers are examples of other suitable insulating materials. The thickness and the thermal conductivity of the fiber mat 20 are not limiting to the invention and should be selected to provide the needed insulation. More particularly, for a fiber mat 20 having a constant thickness, as the thermal conductivity of the mat 20 increases, the amount of heat passing through the mat 20 increases, and the amount of heat passing to the water-cooled pipe increases, and vice versa. Further, for a fiber mat 20 having a constant thermal conductivity, as the thickness of the mat 20 increases, the amount of heat passing through the mat decreases, and the amount of heat passing to the water-cooled pipe decreases, and vice versa.

In the practice of the invention, the fibrous mat 20 has a thermal conductivity lower than the body 16 of the refractory material to reduce the amount of thermal energy or heat passing from the heating chamber of the furnace (not shown) through the body 16 of refractory material to the water-cooled pipe 24. This reduction of thermal energy passing through the body 16 of refractory material to the pipe 24 by the mat 20 results in the body 16 of refractory material and the wire mesh member 18 to increase in temperature. To prevent thermal damage to the wire mesh member 18, according to the invention the thermal conductivity of the body 16 of refractory material is selected to reduce the amount of energy passing through the body 16 to the wire mesh member 18. In this manner, the wire mesh member 18 is protected against thermal damage to maintain the structural stability of the parts 12 and 14, while reducing the amount of thermal energy passing from the furnace to the water-cooled pipe 24. The wire mesh 18 may be embedded as shown in FIG. 1, or it may be abutting the mat 20. As is now appreciated, the instant invention eliminates the need to provide strips of fibrous insulating material in the wire mesh, as disclosed in U.S. Pat. No. 4,189,301, to prevent thermal damage to the wire mesh.

In the practice of the invention but not limited thereto, the body 16 of the refractory material has a thermal conductivity of less than 0.60 British thermal units/hour/ft/degrees Fahrenheit ("Btu/hr/ft/°F"), preferably 0.30-0.60 Btu/hr/ft/°F, most preferably 0.40-0.50 Btu/hr/ft/°F, e.g., 0.45 Btu/hr/ft/°F. In the preferred practice of the invention, the material of the fibrous mat 20 has a thermal conductivity lower than the body 16 of the refractory material, e.g. and not limiting to the invention, preferably, the material of the mat 20 has a thermal conductivity less than 0.15 Btu/hr/ft/°F, preferably less than 0.10 Btu/hr/ft/°F, and, more preferably, less than 0.05 Btu/hr/ft/°F. In another non-limiting embodiment of the invention, the mat 20 has a thermal conductivity in the range of 0.05-0.15 Btu/hr/ft/°F. In still another non-limiting embodiment of the invention, the mat 20 has a thermal conductivity equal to or less than 25%, and preferably 10%, of the thermal conductivity of the refractory material. A fibrous mat that can be used in the practice of the invention but not limited thereto can be ½-inch thick Fiberfrax™ paper #550 sold by Unifrax of Niagara Falls, N.Y.

The parts 12 and 14 are fabricated in any convenient manner, e.g. and not limiting to the invention, by pressing or casting. In a preferred practice of the invention, the part 12 or 14 is formed by pressing. In general and not limiting to the invention, the pressing process includes positioning the mat 20 on inner convex surface of a suitable mold (not shown), which will provide inner surface for the part 12 or 14 on outer surface of the pipe 24 and positioning the wire mesh member 18 in the mold adjacent and preferably, but not limiting to the invention, on top of the mat 20. The fluid refractory material, e.g., pourable or semi-fluid "plastic" particle refractory, is poured or scooped into the mold. The fluid refractory material in the mold is hydraulically pressed with vibration applied to aid in filling the mold with the fluid refractory material and the mold heated to a temperature to cure the refractory material without thermally damaging the refractory material, the fibrous mat 20, or the wire mesh member 18. The other part 14 or 12 is made in a similar manner. In another non-limiting embodiment of the invention, the part 12 or 14 is formed by casting. In general and not limiting to the invention, the casting process includes positioning the mat 20 on inner convex surface of a suitable mold (not shown), which will provide inner surface for the part 12 or 14 on outer surface of the pipe 24, and positioning the wire mesh member 18 in the mold adjacent and preferably, but not limiting to the invention, on top of the mat 20. The fluid refractory material, e.g., pourable or semi-solid "plastic" particle refractory material, is poured or scooped into the cast and is cured to provide the part 12 or 14. The other part 14 or 12 is made in a similar manner. The pressing and casting processes for making refractories is well known in the art and no further discussion is deemed necessary.

Figure 2:
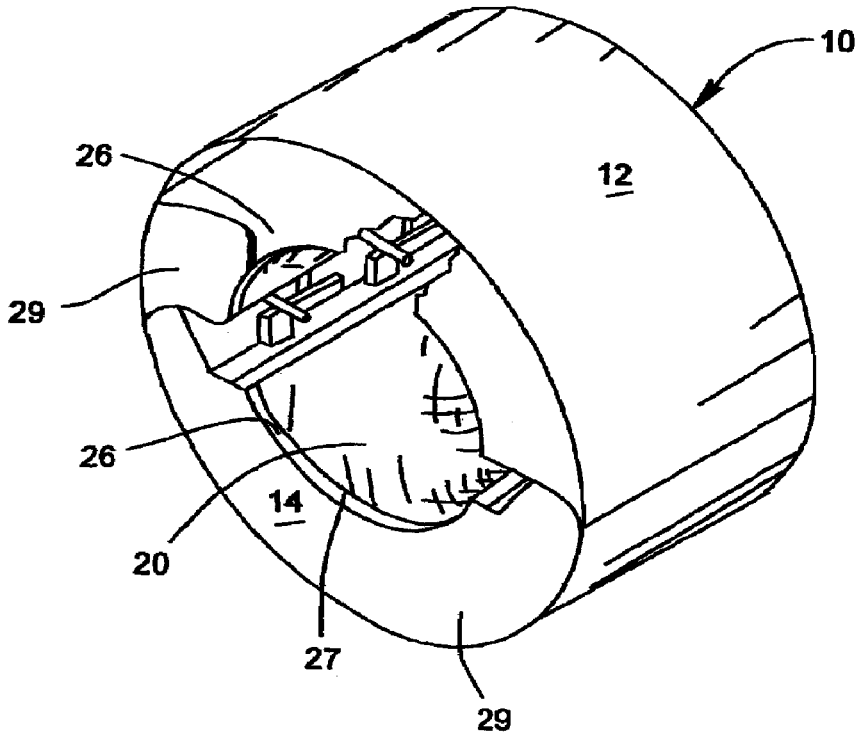
FIG. 2 is an isometric view of the insulation member of FIG. 1, with the water-cooled pipe omitted and portions removed for purposes of clarity.

The fiber mat 20 is embedded or retained on the inner surface 22 of the refractory parts 12 and 14 (inner surface 22 shown in FIG. 1) by the infiltration of small amounts of the fluid refractory material into the surface of the mat 20 during the pressing or casting process. In one non-limiting embodiment of the invention, a periphery 27 of the mat 20 is spaced from ends 29 of the parts 12 and 14 of the mold 10 to provide a frame 26 of refractory material around the periphery 27 of the mat 20 (see FIGS. 2). In one non-limiting embodiment of the invention, the spaced distance is 0.75 inch and, preferably, 0.50 inch. As can be appreciated, the frame 26 of the refractory material can be eliminated and the periphery 27 of the mat 20 can extend to the ends 29 of the parts 12 and 14.

Figure 3:
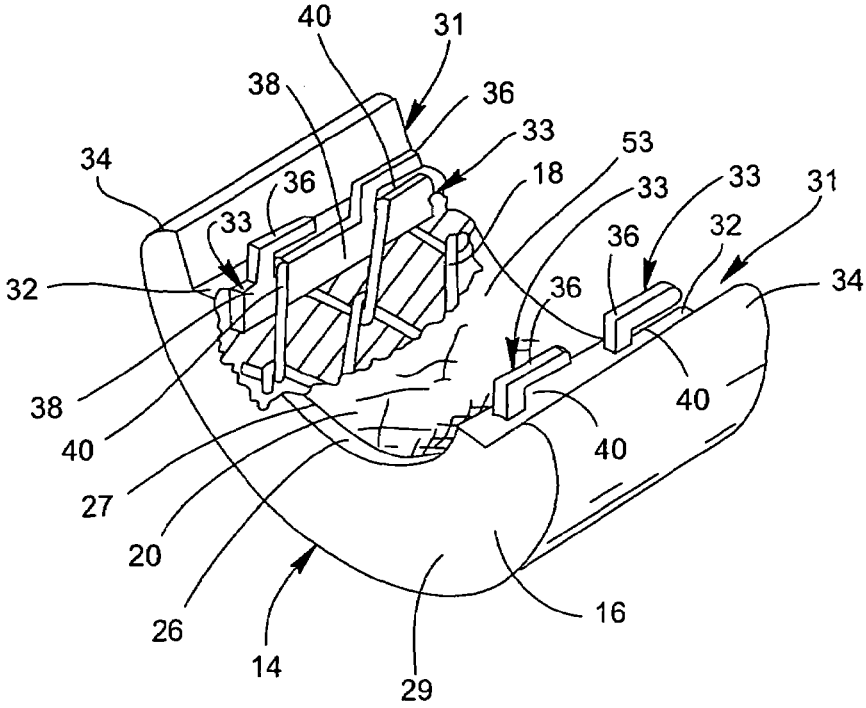
FIG. 3 is an isometric view, partly broken away, showing the hook half of one of the parts of the insulation member shown in FIG. 2.
Figure 4:
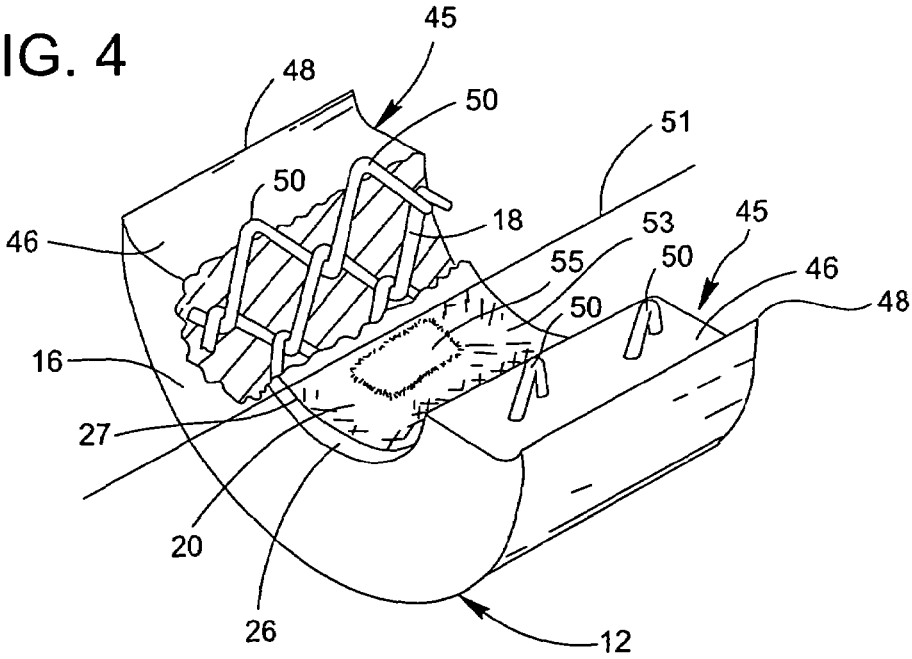
FIG. 4 is an isometric view, partly broken away, showing the loop half of the other one of the parts of the insulation member shown in FIG. 2.

The discussion is now directed to a non-limiting arrangement that can be used in the practice of the invention to secure the parts 12 and 14 together about an absorptive element, e.g., the pipe 24 shown in FIG. 1, to thermally insulate the pipe 24 and to protect the pipe 24 against structural damage in accordance with the teachings of the invention. With reference to FIGS. 3 and 4, and not limiting to the invention, each of the parts 12 and 14 are semi cylindrical and secured together, as disclosed in U.S. Pat. No. 4,182,609. More particularly and with reference to FIG. 3, the part 14 includes two parallel longitudinal edges 31 comprised of an inner longitudinal recessed portion 32 adjacent the mat 20 and a built-up external longitudinal portion 34 adjacent thereto. The part 14 further includes two clips 33, each of which is connected to the reticulated wire mesh member 18 in the area of the longitudinal edges 31 so as to be embedded partially within the part 14.

Each one of the clips 33 includes two hooks 36, which initially extend outward from clip body 38 at right angles thereto and then extend parallel to the clip body 38 as shown in FIG. 3 to form a recess 40, which extends into the clip body 38. The recesses 40 accommodate the reticulated wire mesh member 18 so as to secure the clips 33 thereto. The clips 33 are embedded within the part 14 so that the only portion which extends outward therefrom is the hook 36, which are in alignment with one another. These hooks 36 extend out from the part 14 along the recessed inner portion 32 of the longitudinal edges 31, as shown for the right side of the part 14 in FIG. 3.

With reference to FIG. 4, the part 12 also has two parallel longitudinal edges 45 comprised of a recessed inner portion 46 adjacent the mat 20 and an outer built-up section 48 adjacent to the recessed portion 46. The reticulated wire mesh member 18 extends out of the respective longitudinal edges 45 in the area of the recessed inner portion 46 to form two closed loops 50 along each edge 45. The loops 50 are in angular relationship to longitudinal axis 51 of the heat-insulating refractory member 10 (also see FIG. 1) to form openings, which are in alignment with one another.

The parts 12 and 14 of the refractory member 10 are joined together about an absorptive element, e.g., the water-cooled pipe 24, to be thermally insulated and, optionally, protected by positioning each part about the water-cooled pipe 24 and inserting the hooks 36 of the part 14 into the loops 50 of the part 12 to form the connection and the refractory article or member 10 of the invention.

For a more detailed discussion of joining the parts 12 and 14 together and for a discussion of other forms of connecting refractory parts around water-cooled structural parts for furnaces, reference can be had to U.S. Pat. No. 4,182,609.

As can now be appreciated, the invention also contemplates securing the parts 12 and 14 to absorptive elements, e.g., water-cooled members, in any other convenient manner, e.g., by welding as disclosed in U.S. Pat. No. 2,693,352, the disclosure of which is hereby incorporated by reference.

The fibrous thermal insulating mat 20, as shown in FIGS. 3 and 4, has an exposed outer surface 53. Although not limiting to the invention, the invention contemplates protecting the mat 20 against damage during storage and handling of the parts 12 and 14 by applying a protective layer 55 (a segment of the layer 55 shown only in FIG. 4) over the exposed surface 53 of the mat 20. The invention is not limited to the material of the protective layer 55. In one non-limiting embodiment of the invention, the protective layer 55 is paper-packing tape having an adhesive surface. The adhesive surface of the packing tape is applied to the outer surface 53 of the mat 20. In use, the heat from the furnace passing through the heat-insulating refractory member 10 to the water-cooled pipe 24 burns the packing tape 55.

While specific embodiments of the invention have been described in detail, it can be appreciated by those skilled in the art that this invention is not limited to the particular embodiments disclosed and that various modifications and alternatives to those embodiments can be developed in light of the overall teachings of the disclosure, and it is intended to cover such modifications and alternatives that are within the spirit and scope of the invention as defined by the appended claims.

What is claimed is:

1. In a thermo-insulation article of the type for insulating a heat absorptive element in a heated chamber and having at least two parts adapted to be connected to form a heat insulating member for positioning about the element, each part comprising a metal structure in a refractory material, wherein a surface of the refractory material of the parts defined as an inner surface is designated to face the absorptive element, the improvement comprising:

a ceramic fibrous mat having a first surface and an opposite second surface, with the first surface of the mat secured to the inner surface and the second surface of the mat facing the same direction as the inner surface to which the first surface of the mat is secured, wherein the first surface of the ceramic fibrous mat is embedded in the refractory material of its respective part.

2. The thermo-insulation article of claim 1, wherein the ceramic fibrous mat has a thermal conductivity lower than thermal conductivity of the refractory material.

3. The thermo-insulation article of claim 2, wherein the ceramic fibrous mat has a thermal conductivity equal to or less than 25% of the thermal conductivity of the refractory material.

4. The thermo-insulation article of claim 3, wherein the ceramic fibrous mat has a thermal conductivity equal to or less than 10% of the thermal conductivity of the refractory material.

5. The thermo-insulation article of claim 2, wherein the ceramic fibrous mat has a thermal conductivity equal to or less than 0.15 British thermal units/hour/foot/degrees Fahrenheit.

6. The thermo-insulation article of claim 5, wherein the ceramic fibrous mat has a thermal conductivity equal to or less than 0.10 British thermal units/hour/foot/degrees Fahrenheit.

7. The thermo-insulation article of claim 5, wherein the ceramic fibrous mat has a thermal conductivity equal to or greater than 0.05 British thermal units/hour/foot/degrees Fahrenheit.

8. The thermo-insulation article of claim 5, wherein the thermal conductivity of the refractory material of the at least two parts has a thermal conductivity in the range of 0.30-0.60 British thermal units/hour/foot/degrees Fahrenheit.

9. The thermo-insulation article of claim 5, wherein density of the refractory material of the parts on a dry basis is in the range of 80-110 pounds/cubic foot and modulus of rupture of the refractory material of the parts on a dry basis is in the range of 550-1,000 pounds/square inch.

10. The thermo-insulation article of claim 1, wherein each of the parts has a first side and an opposite second side, and the mat of each part has a first edge and an opposite second edge, with the first edge of the mats adjacent and spaced from the first side of their respective one of the parts and the second edge of the mats adjacent and spaced from the second side of their respective one of the parts, and a ledge of refractory material between the ends of the parts and the respective edge of their respective mat.

11. The thermo-insulation article of claim 10, wherein the ledge has a height of less than 0.75 inch.

12. The thermo-insulation article of claim 11, wherein the ledge has a height of 0.50 inch.

13. The thermo-insulation article of claim 1, further comprising a protective layer over second surface of the ceramic fibrous mat.

14. The thermo-insulation article of claim 1, wherein the metal structure is a reticulated metal structure solidly embedded in the refractory material.

15. A method of making a thermo-insulation article, comprising the steps of:

positioning a ceramic fibrous mat on an inner convex surface of a mold, the mat having a predetermined thermo conductivity;

positioning a wire mesh in the mold over the mat;

adding a fluid refractory material to the mold; and solidifying the fluid refractory material to provide a part of the thermo-insulation article, wherein the solidified refractory material has a predetermined thermo conductivity greater than the thermo conductivity of the mat.

16. The method according to claim 15, including the step of repeating the steps of positioning a ceramic fibrous mat, positioning a wire mesh, adding a fluid refractory material, and solidifying the fluid refractory material to provide a second part of the thermo-insulating article, wherein joining the first and second parts provides the thermo-insulating article.

17. The method according to claim 15, wherein the mat has a first surface and an opposite second surface and the first surface of the mat is positioned on the inner convex surface of the mold, and further comprising the steps of removing the part from the mold and applying a protective layer over the first surface of the mat.

18. The method according to claim 15, wherein the adding step includes the step of pressing the fluid refractory material while vibrating the fluid refractory material to fill the mold.

19. The method according to claim 18, wherein the solid refractory material has a thermal conductivity in the range of 0.30-0.60 British thermal units/hour/foot/degrees Fahrenheit, a density of 80-110 pounds/cubic foot, and a modulus of rupture in the range of 550-1,000 pounds/square inch.

* * * * *

UNITED STATES PATENT AND TRADEMARK OFFICE

CERTIFICATE OF CORRECTION

PATENT NO. : 7,628,611 B2
APPLICATION NO. : 11/496015
DATED : December 8, 2009
INVENTOR(S) : Beiter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 374 days.

Signed and Sealed this

Second Day of November, 2010

David J. Kappos

David J. Kappos
*Director of the United States Patent and Trademark Office*